US008083202B1

(12) United States Patent
Hutchison

(10) Patent No.: US 8,083,202 B1
(45) Date of Patent: Dec. 27, 2011

(54) ATTACHABLE HANGING HOOK

(76) Inventor: Laura L. Hutchison, Moorpark, CA (US)

( * ) Notice: Subject to any disclaimer, the term of this patent is extended or adjusted under 35 U.S.C. 154(b) by 0 days.

(21) Appl. No.: 13/111,026

(22) Filed: May 19, 2011

(51) Int. Cl.
*A47G 29/00* (2006.01)

(52) U.S. Cl. ..... 248/691; 248/692; 248/914; 248/307; 248/341; 223/DIG. 4

(58) Field of Classification Search ..... 248/691, 248/690, 692, 914, 303, 307, 339, 341; 223/120, 223/94, 91, 85, DIG. 4
See application file for complete search history.

(56) References Cited

U.S. PATENT DOCUMENTS

| | | | | |
|---|---|---|---|---|
| 253,737 | A * | 2/1882 | McDonald | 248/308 |
| 253,942 | A * | 2/1882 | Onderdonk | 248/308 |
| 2,473,086 | A * | 6/1949 | Montero | 248/308 |
| 2,555,890 | A * | 6/1951 | Korth | 224/575 |
| 2,842,822 | A * | 7/1958 | Bennett | 24/370 |
| 3,958,675 | A | 5/1976 | Rosenblum | |
| 4,091,976 | A | 5/1978 | Morse | |
| 4,342,479 | A | 8/1982 | Hofer | |
| D339,979 | S | 10/1993 | Wehrley | |
| 5,352,006 | A | 10/1994 | Ocuin | |
| D632,952 | S * | 2/2011 | Dablemont | D8/367 |
| 7,922,140 | B2 * | 4/2011 | Carver | 248/339 |
| 2006/0108497 | A1 * | 5/2006 | Miranda | 248/690 |
| 2009/0294491 | A1 | 12/2009 | Carver | |

OTHER PUBLICATIONS

Prensus.Multi-Purpose Portable Hanger. http:www.prensusphd.com/ Accessed Feb. 19, 2010.

* cited by examiner

*Primary Examiner* — Anita M King
(74) *Attorney, Agent, or Firm* — Montgomery Patent & Design, LLC; Robert C. Montgomery; Joseph T. Yaksich

(57) ABSTRACT

An attachable hanging hook for removably hanging a carrying bag from an upper edge of a vertical support surface or from an edge of a horizontal support surface includes a pair of hooks and a central joint. A first hook is pivotably movable about the joint and a second hook is rotatably movable about the joint. Depending upon the orientation of the hooks relative to one another, the carrying bag can be securely suspended from a horizontal support or a vertical support. The joint also allows the hooks to be collapsibly folded onto one another for storage.

19 Claims, 7 Drawing Sheets

ATTACHABLE HANGING HOOK

RELATED APPLICATIONS

The present invention was first described in a notarized Official Record of Invention on Jan. 18, 2010, that is on file at the offices of Montgomery Patent and Design, LLC, the entire disclosures of which are incorporated herein by reference.

FIELD OF THE INVENTION

The present invention relates generally to carrying bag hanging devices, and in particular, to an attachable hanging hook for suspending a carrying bag from an edge of a generally horizontal support surface and from an upper edge of a generally vertical support surface.

BACKGROUND OF THE INVENTION

Everyone is familiar with the hanging garment bag. Not only does it do a great job with keeping one's clothes clean and wrinkle free, but it also has a large hook which can be placed over almost any object such as a door, a bathroom stall divider, a cabinet, chair, or the like. The hook allows all compartments of the bag to be easily accessed when there is no suitable place to set the bag down and eliminates having to place the bag on a dirty floor. Unfortunately, such versatility is not available in bags of other styles such as purses, briefcases, gym bags, diaper bags and the like. This means that in locations such as locker rooms, hotel rooms, and public bathrooms the bag must be set on the dirty floor.

In addition, the traditional carrying bag hook is not useful on a horizontal surface such as a table or a bar. Often times woman do not want to leave their purse or similar carrying bag on the floor or on an adjacent chair. However, there is rarely a hook or protrusion available to hang the bag on.

While various garment bag hooks and table top bag hanger exist, each suffers from one or more disadvantage or deficiency related to design or utilization. Particularly, each device lacks the functionality of the other.

SUMMARY OF THE INVENTION

The inventor has therefore recognized the aforementioned inherent problems and lack in the art and observed that there is a need for a device in which the versatility of a large hanging hook can be made available to all styles of carried bags. In accordance with the invention, it is an object of the present disclosure to solve these problems.

The inventor recognized these problems and has addressed this need by developing an attachable hanging hook that provides a means to attach almost any type of bag to any type of surface, thus keeping them off of the floor in a manner which is quick, easy, and effective. The inventor has thus realized the advantages and benefits of providing the attachable hanging hook having a first hook with a first stem and a first curvature to supportingly retain a carrying bag. A second hook is also provided and joined to the first hook by a joint. The joint includes a ball affixed to an end of the first stem and a hollow socket for retaining the ball. The socket also includes a first hook slot through which the first hook protrudes outwardly therefrom such that the first hook is movable within the slot. The second hook includes a second stem rotatably attached within an opening in the socket such that the second hook is rotatable about three hundred sixty degrees relative to the socket and a second curvature to supportingly retain the carrying bag. The first hook is longitudinally aligned with the second hook such that the first curvature directionally opposes the second curvature when the second hook is engaged over an upper edge of a generally vertical support surface to suspend the carrying bag from the vertical support surface. Additionally, the first hook is perpendicularly oriented to the second hook such that the first curvature rests atop a generally horizontal support surface adjacent to an edge to suspend the carrying bag from the horizontal support surface.

In an embodiment of the hanging hook, the joint includes a pivot pin extending between an interior of the socket and through the ball to restrict the pivoting motion of the first hook to a single axis.

In an embodiment of the hanging hook, the slot includes opposing scalloped edges, each having a plurality of semicircular indentations for selectably retaining the first stem at a selectable position within the slot.

In an embodiment of the hanging hook, a chain is affixed to an exterior of the socket to releasably attach to an interior of the carrying bag when not in use.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

| | |
|---|---|
| 10 | attachable hanging hook |
| 11 | horizontal surface |
| 12 | vertical surface |
| 20 | first hook |
| 21 | first curvature |
| 22 | first stem |
| 25 | first foot |
| 30 | second hook |
| 31 | second curvature |
| 32 | second stem |
| 35 | second foot |
| 36 | "T"-feature |
| 40 | joint |
| 41 | first hook slot |
| 42 | ball |
| 43 | non-rotational pin |
| 44 | second hook opening |
| 45 | socket |
| 50 | first alternate embodiment |
| 51 | scalloped edge |
| 52 | indentation |
| 60 | second alternate embodiment |
| 61 | loop |
| 62 | chain |

DETAILED DESCRIPTION OF THE PREFERRED EMBODIMENT

Figure 5:
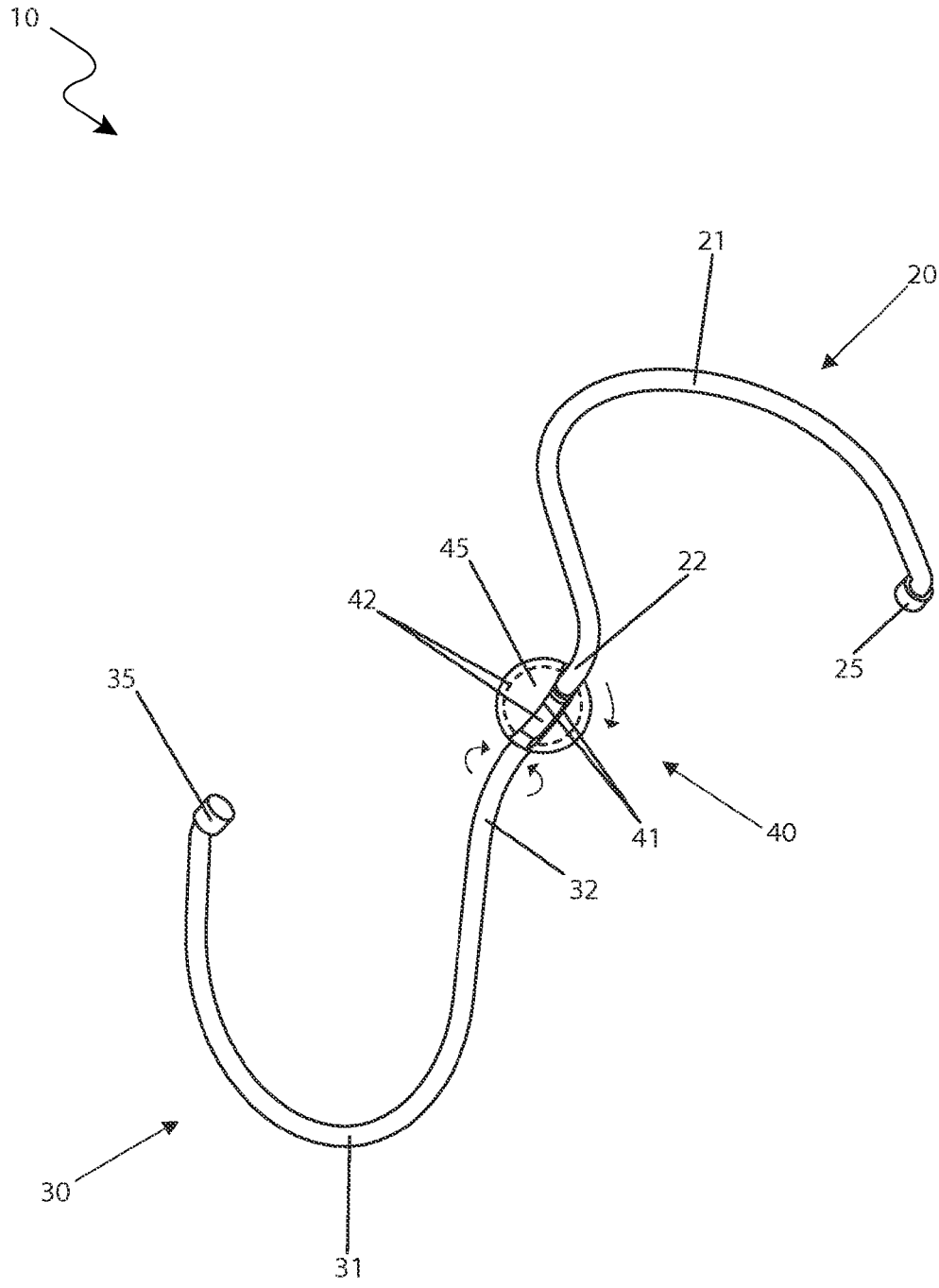
FIG. 5 is a perspective view of the attachable hanging hook, according to the preferred embodiment.
Figure 6:
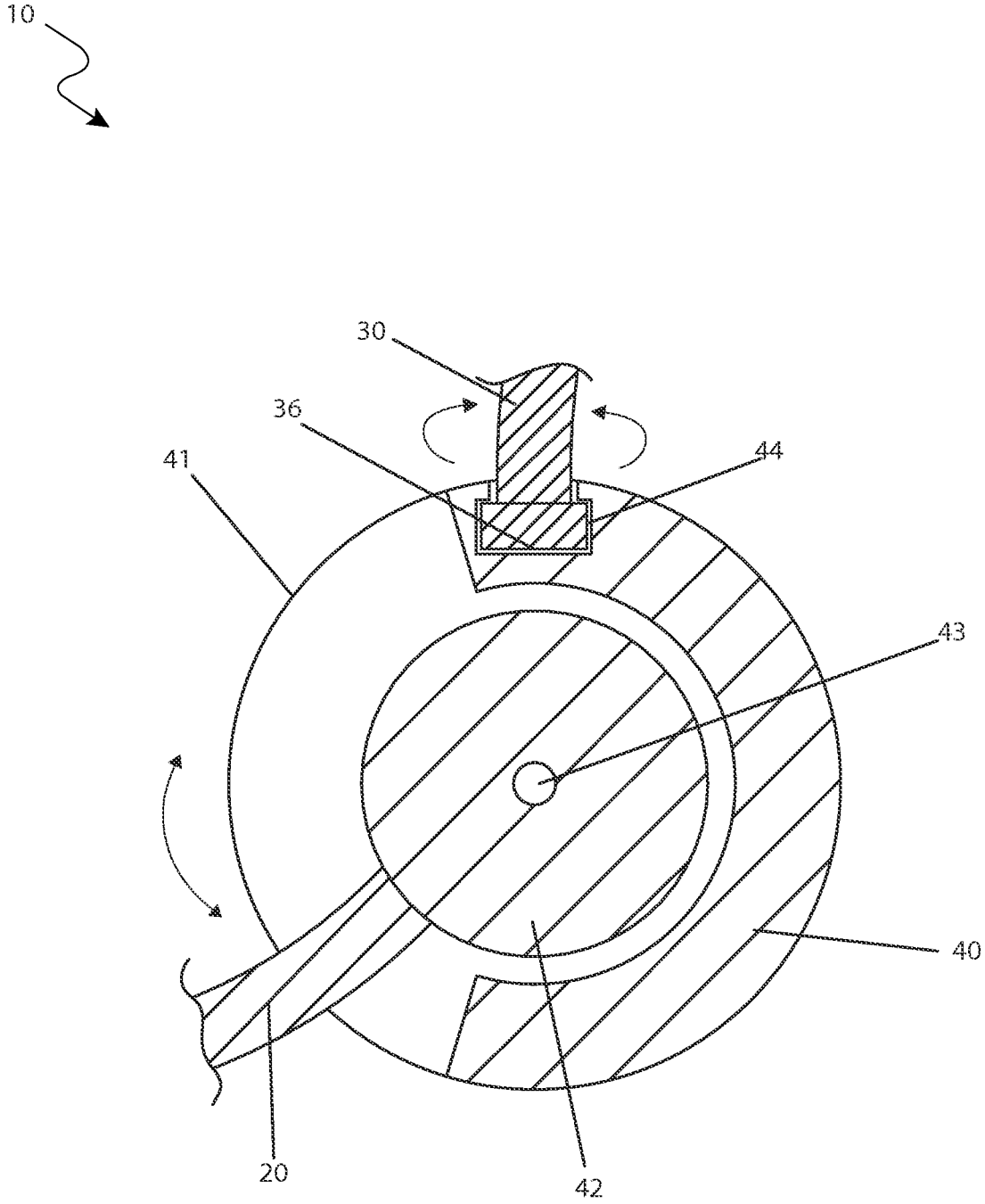
FIG. 6 is a section view of a joint taken along section line A-A of FIG. 2, according to the preferred embodiment.
Figure 7:
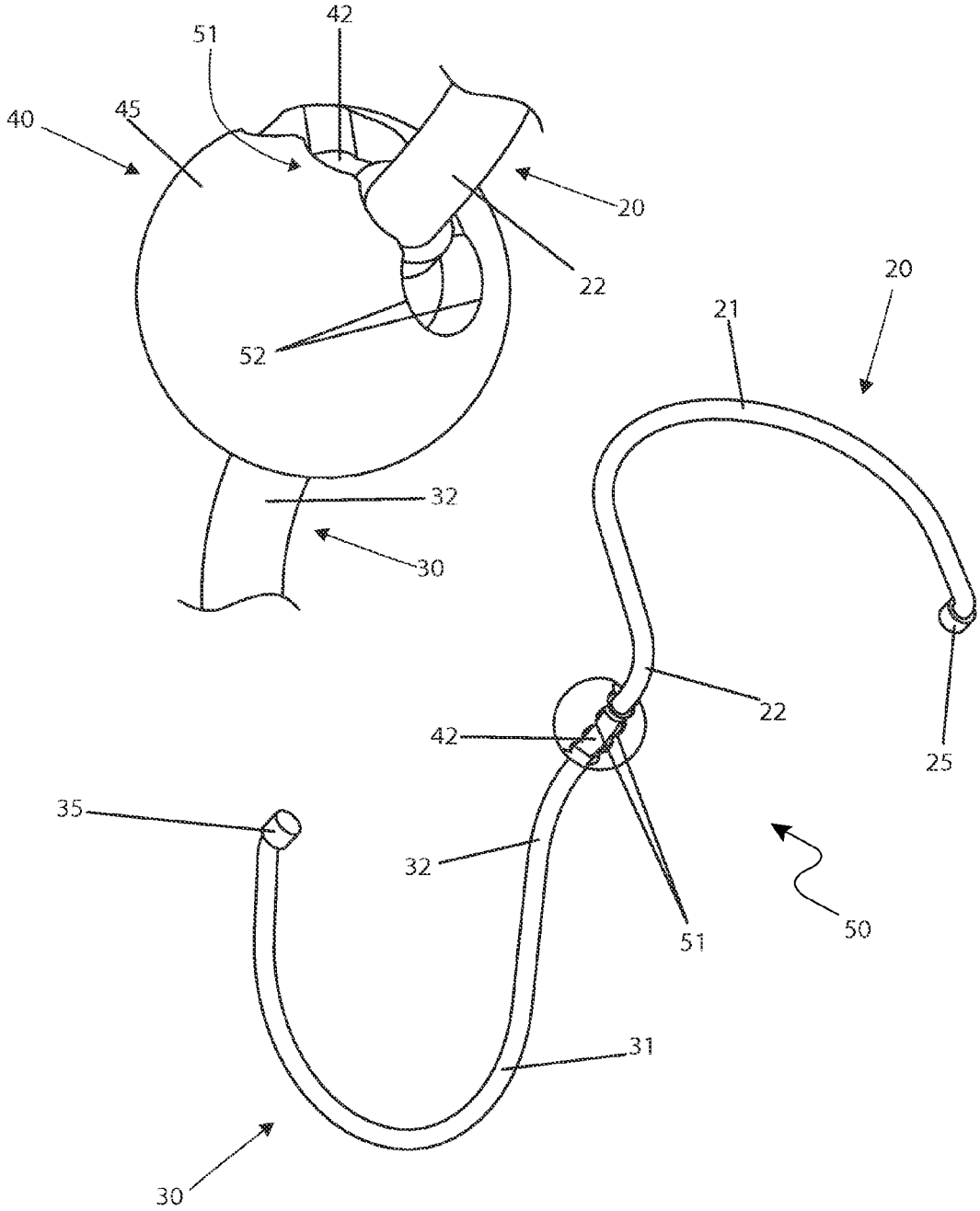
FIG. 7 is a perspective view of an alternate embodiment of the attachable hanging hook in accordance with the invention; and, FIG. 8 is a perspective view of an alternate embodiment of the attachable hanging hook in accordance with the invention.
Figure 8:
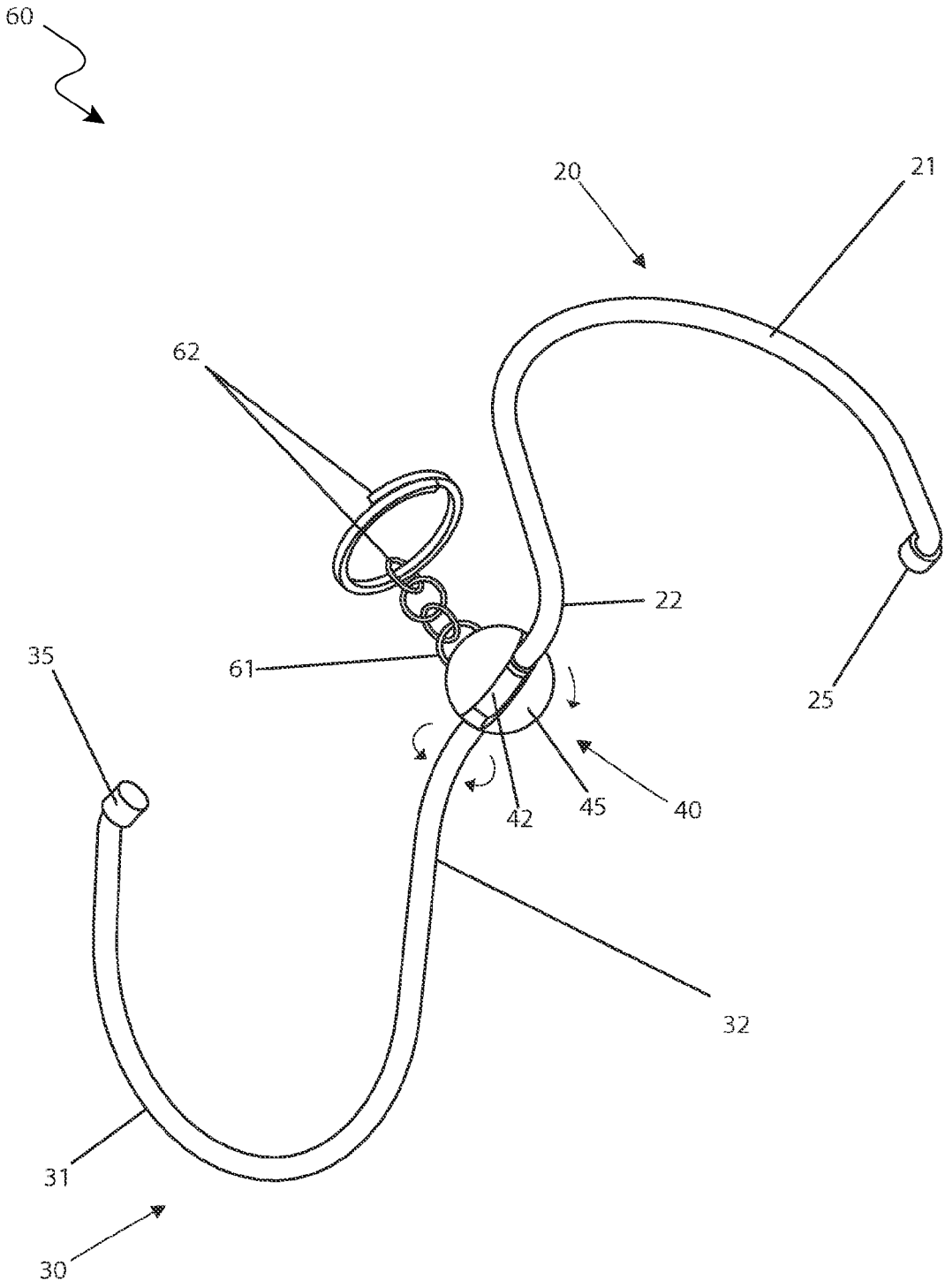

In accordance with the invention, the best mode is presented in terms of a preferred embodiment, herein depicted within FIGS. 1 through 6 and alternately within FIGS. 7 and 8. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 8, depicting an attachable hanging hook (herein described as the "device") 10, where like reference numerals represent similar or like parts. In accordance with the invention, the present disclosure describes an attachment hook which provides for suspending items from various surfaces when no hanger option is readily available, which in turn frees up areas which have limited space or eliminates setting the items upon dirty surfaces.

Figure 1:
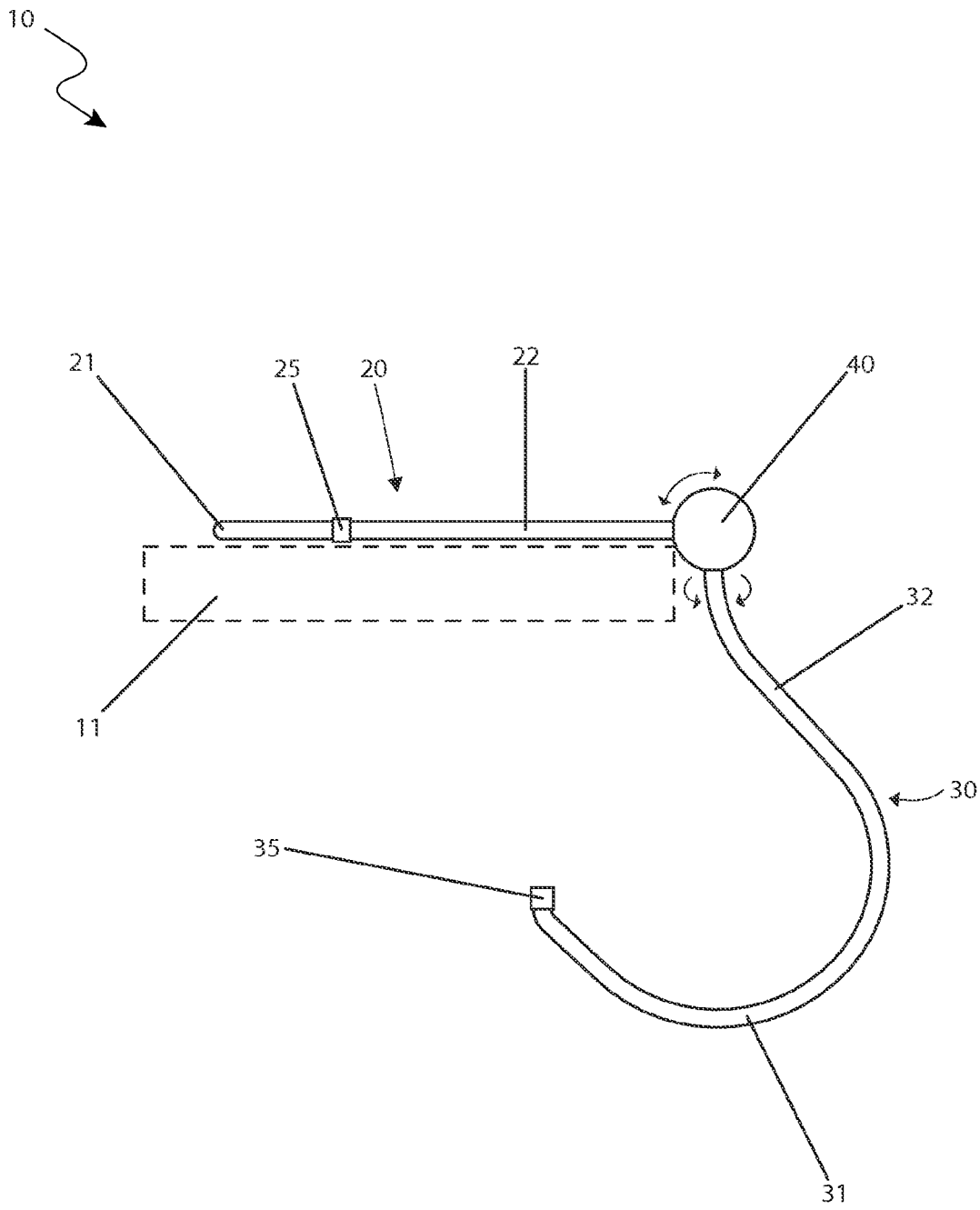
FIG. 1 is an environmental view of an attachable hanging hook depicted in use on a horizontal support surface, according to a preferred embodiment in accordance with the invention.
Figure 2:
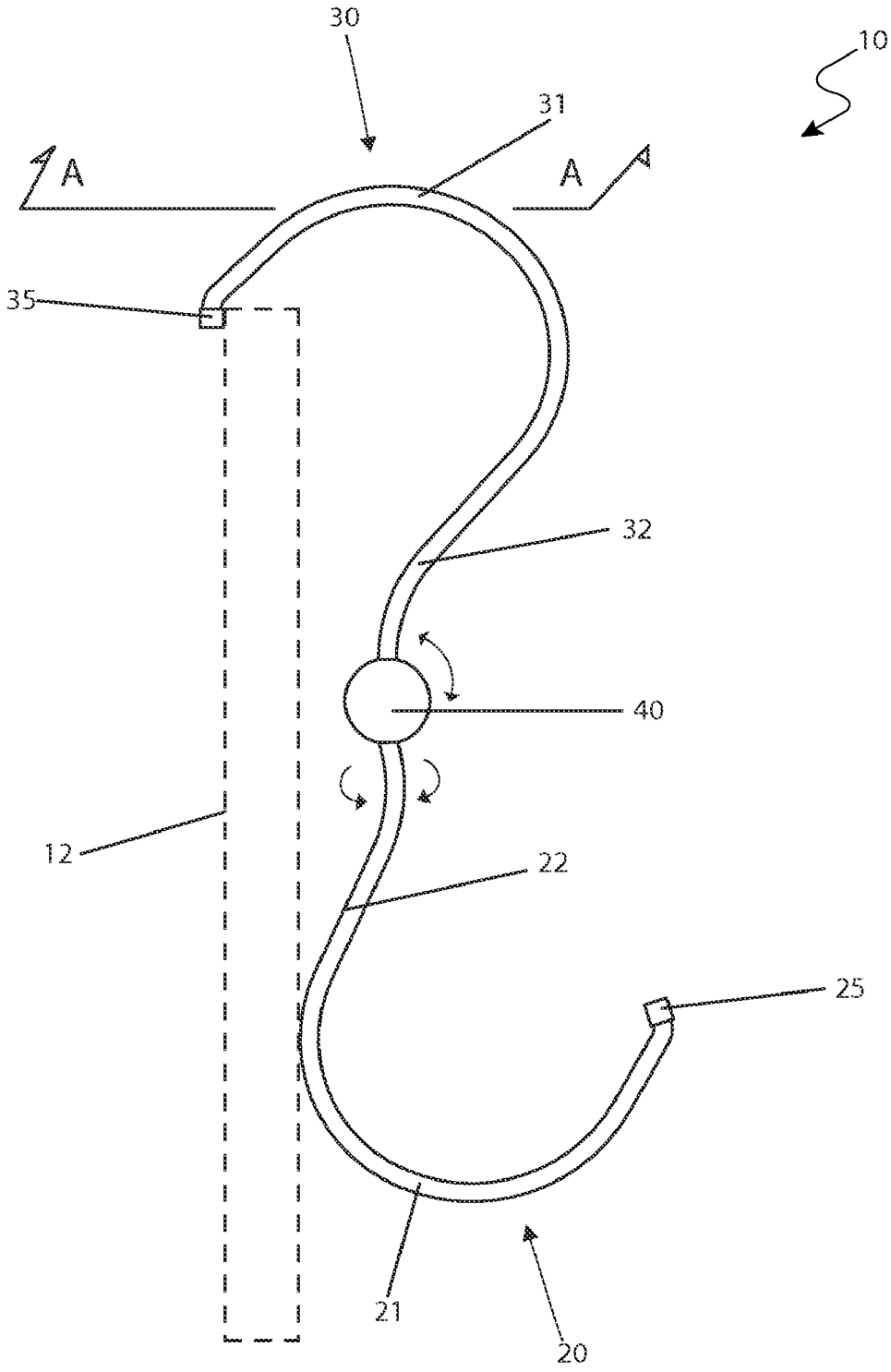
FIG. 2 is an environmental view of the attachable hanging hook depicted in use on a vertical support surface, according to the preferred embodiment.

FIGS. 1 and 2 show environmental views of the device 10. The device 10 can be utilized upon a horizontal surface 11 such as a table top, a desk, a bar, or similar surface or a vertical surface 12 such as a door, cabinet, or similar surface. Each of the mentioned utilizations of the device 10 suspend a desired article such as, but not limited to: purses, briefcases, luggage, or the like each of which typically include at least one (1) strap or handle for carrying purposes and a compartment for placing various personal or professional articles. The device 10 comprises a first hook 20 and a second hook 30 which are hingedly engaged and provide various suspending options to the desired article. The first hook 20 and the second hook 30 must maintain a center of gravity to balance the desired article on either of the hooks 20, 30.

The first hook 20 can be used to suspend the article from a vertical surface 11 as shown in FIG. 2 or placed atop of a horizontal surface 12 to be a support base as shown in FIG. 1. The first hook 20 and the second hook 30 each comprise a generally "J"-shape providing stem which extends into a curvature to receive and support the article. In use, the first hook 20 is orientated parallel to and abuts against the horizontal surface 11 when the second hook 30 is utilized to suspend the desired article. An end of a first hook curvature 21 includes a first foot 25 preferably made of a rubberized material which reduces marring and provides additional securing of the device 10 onto the desired surface 11, 12. The first hook 20 is fabricated from an anti-corrosive durable material such as, but not limited to: stainless steel, plastic, or the like.

The second hook 30 can be used to suspend the article from the horizontal surface as shown in FIG. 1 or be placed over top of an upper edge of a vertical surface 12 to be a support base as shown in FIG. 2. The second hook 30 is oriented generally perpendicular to the first hook 20. An end of a second curvature 31 includes a second foot 35 similar in material and function as the first foot 25, which reduces marring and provides additional securing of the device 10 onto the desired surface 11, 12. The second hook 30 is fabricated from a material similar to the first hook 20.

Figure 3:
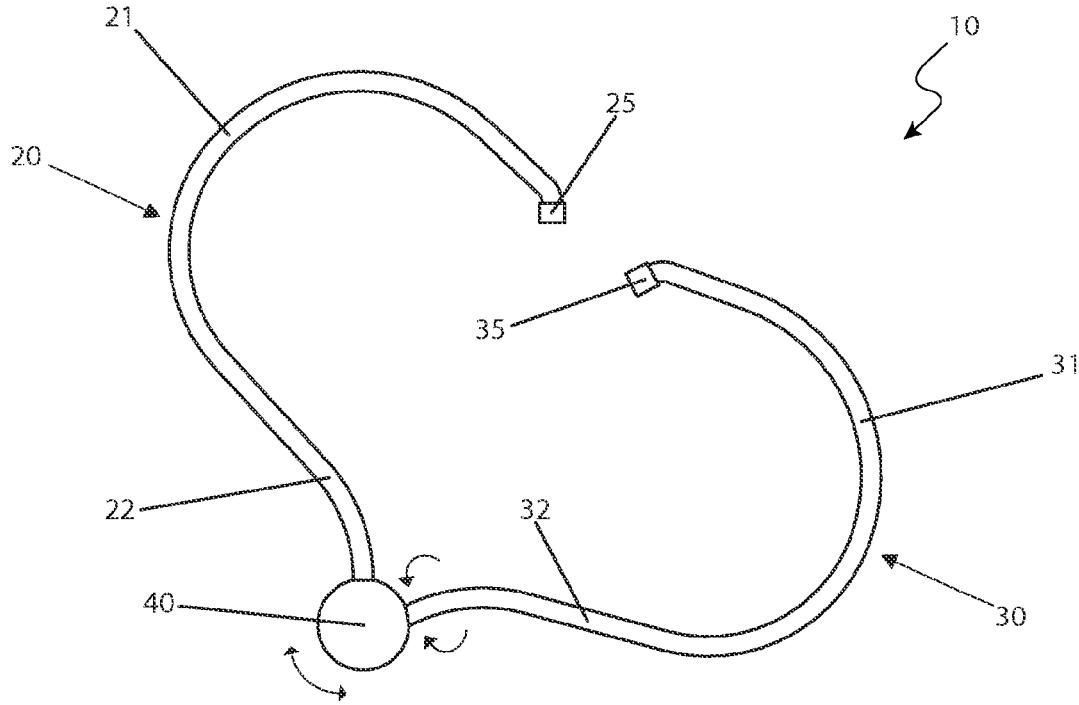
FIG. 3 is a side view of the attachable hanging hook depicted in a partially collapsed state, according to the preferred embodiment.
Figure 4:
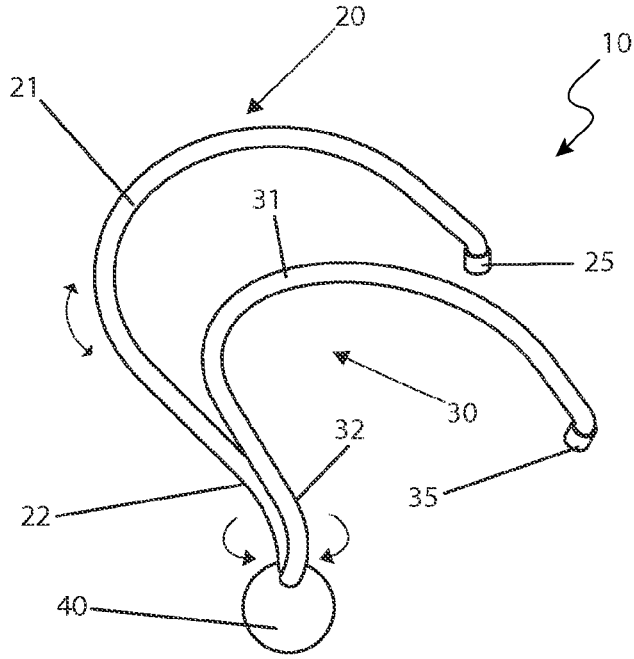
FIG. 4 is a side view of the attachable hanging hook depicted in a fully collapsed state, according to the preferred embodiment.

FIGS. 3 and 4 show side views of the device 10 depicted in a partially collapsed state and a fully collapsed state. The hooks 20, 30 are interconnected at a central location by a joint 40 (also see FIGS. 5 and 6). The joint 40 is similar to a ball-and-socket joint that allows the first hook 20 to be rotatably manipulated toward the second hook 30 and also allows the second hook 30 to be rotatably manipulated three-hundred-and-sixty degrees) (360°). The joint 40 is fabricated from a material similar to the hooks 20, 30. FIG. 3 depicts the first hook 20 rotated toward the second hook 30 and FIG. 4 depicts the second hook 30 rotated in an opposing direction such that the first curvature 21 and the second curvature 31 are aligned and parallel. The aforementioned configurations are utilized for storing the device 10 in a pocket, purse, or the suspended article when not in use.

FIG. 5 shows perspective view of the device 10 and FIG. 6 shows a section view of a joint 40 taken along section line A-A of FIG. 2. The joint 40 comprises a hollow spherical socket 45 which includes a first hook slot 41, an internal ball 42, and a second hook opening 44. The first hook 20 is integral to the ball 42 and protrudes outwardly from the first hook slot 41 and is pivotably within the socket 45 about an axis transverse to longitudinal axis of an aligned first stem 22 and second stem 32. The first hook slot 41 is a slot which extends along a circumference of the socket 45 to allow the first hook 20 to be positioned in the collapsed state. The ball 42 is prohibited from rotating in more than a single direction by a non-rotational pin 43 which is positioned through the center of the ball 42 and secured to an interior surface of the socket 45.

The second hook 30 is attached within a second hook opening 44 approximately one-hundred-and-eighty degrees (180°) from the furthest most upward position of the first hook 20. An end of the second stem 32 opposite the second curvature 31 includes a "T"-shaped feature 36 which fits within the second hook opening 44 and allows the second hook 30 to freely rotate three-hundred-and-sixty degrees (360°) therewithin such that the second hook 30 can be properly positioned at a desired orientation relative to the first hook 20 for supporting the desired article.

FIG. 7 shows a perspective view of the alternate embodiment of the attachable hanging hook 50, which provides for the first hook 20 to be selectively locked into a desired position. In this first alternate embodiment 50, the slot 41 includes opposing scalloped edges 51 upon each inner surface which extend the length of the slot 41. The scalloped edges 51 include a plurality of equally spaced and opposingly aligned semi-circular indentations 52 which selectably receive a lower end of the first stem 22 and provide resistance to retain the first hook 20 at a desired selectable angular position. The first hook 20 is positioned between a set of opposing indentations 52 to secure the first hook 20 in the desired position.

FIG. 8 shows a perspective view of an alternate embodiment of the attachable hanging hook 60. This second alternate embodiment 60 includes a loop 61 which is integrally attached to an exterior surface of the joint 40 and provides a location to attach a chain 62 or similar feature for attachment to a desired object such as, but not limited to: a purse, a keychain, or the like. The second alternate embodiment 60 can include features as described within the primary embodiment 10 or the first alternate embodiment 50 and enables each to be secured to and within the article which will be suspended when not in use.

It is envisioned that other styles and configurations can be easily incorporated into the teachings of the present disclosure and only one particular configuration has been shown and described for purposes of clarity and disclosure and not by way of limitation of scope.

In accordance to the invention, the preferred embodiment can be utilized by the user in a simple and effortless manner with little or no training. After initial purchase or acquisition of the device 10, it is installed as indicated in FIGS. 1 and 2.

The method of utilizing the device 10 on a horizontal surface 11 can be achieved by performing the following steps: acquiring the device 10; positioning the first hook 20 flat against the upper surface of the horizontal surface 11 with the joint 40 aligned with the edge of the horizontal surface 11 and the second foot 35 perpendicular with the first foot 25; rotating the second hook 30 to a desired orientation by rotating about the second hook opening 44; suspending an article from the second hook 30; enabling the first foot 25 and second foot 35 to protect surfaces; and, providing a means to attach almost any type of article to any type of surface, thus keeping them off of the floor in a manner which is quick, easy, and effective.

The method of utilizing the device 10 on a vertical surface 13 can be achieved by performing the following steps: acquiring the device 10; rotating the second hook 30 to a desired orientation and positioning upon the upper surface of the vertical surface 12; suspending an article from the first hook 20; enabling the first foot 25 and second foot 35 to protect surfaces; and, providing a means to attach almost any type of article to any type of surface, thus keeping them off of the floor in a manner which is quick, easy, and effective.

The method of utilizing the first alternate embodiment 50 on a horizontal surface 11 can be achieved by performing the following steps: repeating the abovementioned steps for the preferred embodiment 10, yet when positioning the first hook 20 enabling said first hook 20 to engage opposing scalloped edges 51, thereby locking said first hook 20 in a desired position.

The method of utilizing the second alternate embodiment 60 on a horizontal surface 11 can be achieved by performing the following steps: repeating the abovementioned steps for the preferred embodiment 10; attaching the second alternate embodiment 60 to a desired item via the loop 61 and chain 62; and, removing as desired.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An attachable hanging hook comprising:

a first hook having a first stem and a first curvature to supportingly retain a carrying bag;

a ball affixed to an end of said first stem;

a hollow socket for retaining said ball, said socket further comprising a first hook slot through which said first hook protrudes outwardly therefrom such that said first hook is movable within said slot; and, a second hook having a second stem rotatably attached within an opening in said socket such that said second hook is freely rotatable relative to said socket and a second curvature to supportingly retain said carrying bag;

wherein said first hook is longitudinally aligned with said second hook such that said first curvature directionally opposes said second curvature when said second hook is engaged over an upper edge of a generally vertical support surface to suspend said carrying bag from said vertical support surface; and, wherein said first hook is perpendicularly oriented to said second hook such that said first curvature rests atop a generally horizontal support surface adjacent to an edge to suspend said carrying bag from said horizontal support surface.

2. The hanging hook of claim 1, further comprising a pivot pin extending between said socket and through said ball to restrict pivoting motion of said first hook to a single axis.

3. The hanging hook of claim 2, wherein said first hook further comprises a first foot disposed at an end of said first curvature opposite said first stem.

4. The hanging hook of claim 3, wherein said second hook further comprises a second foot disposed at an end of said second curvature opposite said second stem.

5. The hanging hook of claim 4, wherein said first foot further comprises a rubber material to protect said generally horizontal support surface and said generally vertical support surface during use.

6. The hanging hook of claim 5, wherein said second foot further comprises a rubber material to protect said generally horizontal support surface and said generally vertical support surface during use.

7. The hanging hook of claim 2, wherein said slot further comprises opposing scalloped edges, each having a plurality of semi-circular indentations for selectably retaining said first stem at a selectable position within said slot.

8. The hanging hook of claim 2, further comprising a chain affixed to an exterior of said socket.

9. The hanging hook of claim 8, wherein said chain further comprises a clasp for releasably attaching said hanging hook to an interior of said carrying bag during periods of non-use.

10. An attachable hanging hook for suspending a carrying bag from an edge of a generally horizontal support surface and from an upper edge of a generally vertical support surface, said hanging hook comprising:

a generally J-shaped first hook pivotably connected to a joint;

a generally J-shaped second hook rotatably connected to said joint;

wherein said first hook is movable between a position generally in-line with said second hook and a position generally perpendicular to said second hook;

wherein said second hook is movable between a position parallel and aligned with said first hook and a position generally in-line and opposed to said first hook.

11. The hanging hook of claim 10, wherein said joint further comprises:

a ball affixed to an end of said first hook; and, a hollow socket for retaining said ball, said socket further comprising a first hook slot through which said first hook protrudes outwardly therefrom such that said first hook is movable within said slot;

a second hook opening disposed in said socket for retaining said second hook such that said second hook is freely rotatable within said second hook opening.

12. The hanging hook of claim 11, further comprising a pivot pin extending between said socket and through said ball to restrict pivoting motion of said first hook to a single axis.

13. The hanging hook of claim 12, wherein said first hook further comprises a rubber end to protect said horizontal support surface and said vertical support surface during use.

14. The hanging hook of claim 13, wherein said second hook further comprises a rubber end to protect said horizontal support surface and said vertical support surface during use.

15. The hanging hook of claim 14, wherein said slot further comprises opposing scalloped edges, each having a plurality of semi-circular indentations for selectably retaining said first hook at a selectable position within said slot.

16. The hanging hook of claim 15, further comprising a chain affixed to an exterior of said socket.

17. The hanging hook of claim 16, wherein said chain further comprises a clasp for releasably attaching said hanging hook to an interior of said carrying bag during periods of non-use.

18. A method of suspending a carrying bag from a support surface, said method comprising the steps of:

providing a generally horizontal support surface having a flat top surface and at least one edge;

providing a carrying bag having at least one strap;

providing an attachable hanging hook comprising a first hook having a first stem and a first curvature to supportingly retain said carrying bag, a ball affixed to an end of said first stem; a hollow socket for retaining said ball, said socket further comprising a first hook slot through which said first hook protrudes outwardly therefrom such that said first hook is movable within said slot, and a second hook having a second stem rotatably attached within an opening in said socket such that said second hook is rotatably three hundred sixty degrees relative to said socket and a second curvature to supportingly retain said carrying bag;

positioning said first hook such that said first curvature is flat against said top surface of said horizontal support surface;

positioning said socket adjacent to said at least one edge of said horizontal support surface;

orienting said second hook perpendicular to said first hook such that said second curvature is directed inwardly relative to said at least one edge of said horizontal support surface; and, suspending said carrying bag from said second hook.

19. The method of claim 18, further comprising:

providing a generally vertical support surface having an upper edge;

engaging said second hook overtop of said upper edge of said vertical support surface;

orienting said first hook longitudinally in-line with said second hook such that said first curvature directionally opposes said second curvature; and, suspending said carrying bag from said second hook.

* * * * *